United States Patent [19]

Byrne et al.

[11] Patent Number: 4,486,147

[45] Date of Patent: Dec. 4, 1984

[54] TURBOCHARGER AND ROTOR SHAFT ASSEMBLY

[75] Inventors: Joe L. Byrne, Torrance; Hans Egli, Santa Monica, both of Calif.

[73] Assignee: The Garrett Corporation, Los Angeles, Calif.

[21] Appl. No.: 370,011

[22] Filed: Apr. 20, 1982

[51] Int. Cl.[3] ..... F01D 1/02

[52] U.S. Cl. ..... 416/213 R; 416/241 B; 416/244 A; 415/180; 415/212 R; 403/268

[58] Field of Search ..... 415/180, 214, 212 R, 415/143, DIG. 3, DIG. 5; 416/241 B, 213 R, 244 A, 174; 403/265, 267, 268

[56] References Cited

U.S. PATENT DOCUMENTS

| | | | |
|---|---|---|---|
| 2,297,508 | 9/1942 | Schutte | 416/241 |
| 2,433,589 | 12/1947 | Adams | 415/169 |
| 2,769,611 | 11/1956 | Schwarkzopf | 416/198 A |
| 3,801,226 | 4/1974 | Bevan et al. | 416/241 B |
| 3,905,723 | 9/1975 | Torti, Jr. | 416/213 A |
| 3,999,376 | 12/1976 | Jeryan et al. | 416/241 B |
| 4,011,737 | 3/1977 | Kruger et al. | 416/241 B |
| 4,063,850 | 12/1977 | Hueber et al. | 416/241 B |
| 4,123,199 | 10/1978 | Shimizu et al. | 416/241 B |
| 4,152,816 | 5/1979 | Ewing et al. | 416/213 R |
| 4,176,519 | 12/1979 | Kronogard | 416/241 B |
| 4,279,576 | 7/1981 | Okano | 416/241 B |
| 4,293,619 | 10/1981 | Landingham | 416/241 B |
| 4,335,998 | 6/1982 | Siebels | 416/241 B |

FOREIGN PATENT DOCUMENTS

| | | | |
|---|---|---|---|
| 735505 | 5/1943 | Fed. Rep. of Germany . | |
| 2728823 | 1/1979 | Fed. Rep. of Germany | 416/244 A |
| 536245 | 5/1941 | United Kingdom | 415/214 |

*Primary Examiner*—Samuel Scott
*Assistant Examiner*—Brian J. Bowman
*Attorney, Agent, or Firm*—Joseph A. Yanny; J. Henry Muetterties; Albert J. Miller

[57] ABSTRACT

A rotor shaft assembly for use in turbochargers includes a metal shaft having a generally cylindrical female cavity therein concentrically distributed about the axis thereof; and a solid hubbed ceramic turbine wheel having a male stub shaft insertable into the female cavity. The axis of the male stub shafted ceramic turbine is coextensive with the axis of the shaft and the stub shaft is mated with the female receptacle and joined by an adhesive. A turbocharger includes a rotor-shaft assembly of the above-described type, in which the metal to ceramic adhesive joint is located in the turbocharger center housing.

11 Claims, 3 Drawing Figures

TURBOCHARGER AND ROTOR SHAFT ASSEMBLY

The present invention relates to rotor shaft assemblies of the type used in exhaust gas driven turbochargers and which include a turbine rotor coaxially joined with compressors for driving thereof, and more particularly to a solid hubbed ceramic turbine rotor-metal shaft assembly of the described type having a low moment of inertia, corrosion and oxidation resistant turbine which exhibits sufficient meantime between failure rates to present itself as a viable alternative to conventional approaches to rotor shaft assemblies, and even more specifically to ceramic turbine rotor shaft assemblies of the described type which include solid male stub shafts coaxially integral with the turbine and a female cavity in the shaft for mating with the stub shaft and which are adhesively or glue-jointed to coaxially join the turbine rotor and the shaft. More particularly, the present invention deals with a rotor-shaft assembly of the described type for use in turbochargers which include a high strength metal shaft which is matably engaged with a compressor for exhaust gas driving thereof to provide compressed charge air to an internal combustion engine, in which a solid hubbed ceramic turbine wheel includes a solid male stub shaft which is inserted into a generally cylindrically formed female receptacle in the shaft and glued or otherwise adhesively retained therein to coaxially join the shaft, turbine and compressor for rotation about a common axis. Accordingly, the present invention also relates to turbochargers utilizing rotor-shaft assemblies of the above-described type, and in which the glue or adhesive ceramic to metal shaft joint is located in the center housing bearing area.

In typical operation of certain turbomachinery, such as turbochargers, preignited exhaust gases are fed to a turbine to allow the turbine to rotate and thereby capture the available energy in the gases; translate that energy into rotational and mechanical energy and transmit the mechanical energy to a shaft in the form of torque which may be utilized, as in a turbocharger to drive a compressor, to supply supercharged air to an internal combustion engine.

In such applications, response time of the rotor-shaft assembly to increased energy and exhaust gas flow is important. Therefore, low inertia assemblies are required to achieve satisfactory results. Additionally, the high temperature environment of operation in such settings requires a material at the turbine end which is heat, oxidation and corrosion resistant. The use of silicon and derivatives thereof for turbines has therefore been perceived as a viable alternative to the conventional metal turbine approach utilized in most turbochargers today.

However, ceramics because of their lack of ductility and the inability to satisfactorily machine them to a sufficiently smooth surface in a cost efficient manner, cannot be used for the shaft portion of the rotor-shaft assembly, which often engages bearings and the like to allow for smooth, generally faultless rotation thereof. The optimum solution, therefore, is to have a composite rotor shaft assembly which has a ceramic turbine and a metal shaft. Such a marriage, however, is not without inherent difficulties.

A variety of approaches have been taken to the marriage of ceramic rotors with metal shafts. Most exemplary and noteworthy of these approaches is: the use of an axially bored ceramic turbine with center-bolting attachment to the shaft; interference fitting of an irregularly shaped ceramic to a metal shaft; and female receptacled ceramic turbine, male shaft mating techniques. All are in turn replete with their own shortcomings which have proved them to be unsatisfactory solutions and not suitable for commercialization.

In the bored ceramic approach, a ceramic rotor is first formed with an axial aperture therethrough and/or machined to include said aperture. A shaft is then tapped and threaded, the ceramic mated with the shaft and suitably secured thereto by a threaded bolt to secure the ceramic turbine to the shaft. Foremost among the problems encountered with this approach is the lack of sufficiently sophisticated technology acquired for forming a ceramic turbine having an axial aperture. Additionally, an axial aperture at a minimum doubles the tensile stresses on the ceramic when in use. Additionally, because of the difficulty encountered in machining ceramic turbines to the close tolerances required, the scrap rate for this approach is cost prohibitable or alternatively, successfully machined only at excessive costs.

With the technique of interference fitting of irregularly shaped components, a ceramic turbine is formed to include for instance a male stub shaft with a serration or a hex form insertable in a compatible female metal shaft receptacle. This approach, while perhaps more satisfactory than the bored ceramic approach, is nonetheless plagued with its own problems. Particularly problemmatic in this regard is the complex nature of the ceramic forming techniques which are required for successful utilization of this type of approach. Additionally, complex shaft arrangements are also required often resulting in undesirably high localized tensile stress on the ceramic and extremely high fabrication costs.

With the female receptacled ceramic turbine-male shaft mating techniques, the ceramic turbine is formed to include, as the name implies, a female receptacle which receives a metal shaft to engage the same in an interference fit, thereby placing the ceramic near the interengagement area in tension. Since, as is well known in the art, ceramics are weaker in tension than in compression, this approach has also to date proved unsuccessful.

Accordingly, the present invention addresses the problem of supplying a ceramic rotor-metal shaft assembly with an approach which alleviates the problems and shortcomings of the above-described approaches by providing a rotor-shaft assembly for use in turbochargers which includes a high strength metal shaft which is suitable for being joined at opposite ends with a compressor wheel and ceramic turbine for coaxial rotation. The ceramic turbine wheel includes a solid hub which in turn includes a solid cylindrical male stub shaft which is matable with a female receptacle in the shaft and is suitably adhesive or glue bonded therein to form the ceramic to metal joint and prevent excessive tensile stresses on the stub shaft. The interior of the female receptacle includes symmetrical spaced lands distributed about the shaft axis which engage the stub shaft. A plurality of axially directed reliefs are placed in the lands which permit movement of the glue or other adhesive from the bottom of the receptacle to the top during mating. The lands generally engage the solid ceramic stub shaft and upon hardening the glue or other adhesive forms a bond between the ceramic and the metal to form a unitized assembly. Accordingly a turbocharger according to the present invention utilizes a rotor-shaft assembly of the above-described type and locates the adhesive metal to ceramic joint in the center-housing area of the turbocharger near the oil cooled and lubricated bearings to prevent excessive heat induced degredation of the adhesive.

BRIEF DESCRIPTION OF THE DRAWINGS

This invention will be more fully described with reference to the appended drawings wherein.

DETAILED DESCRIPTION OF THE PREFERRED EMBODIMENT

Figure 1:
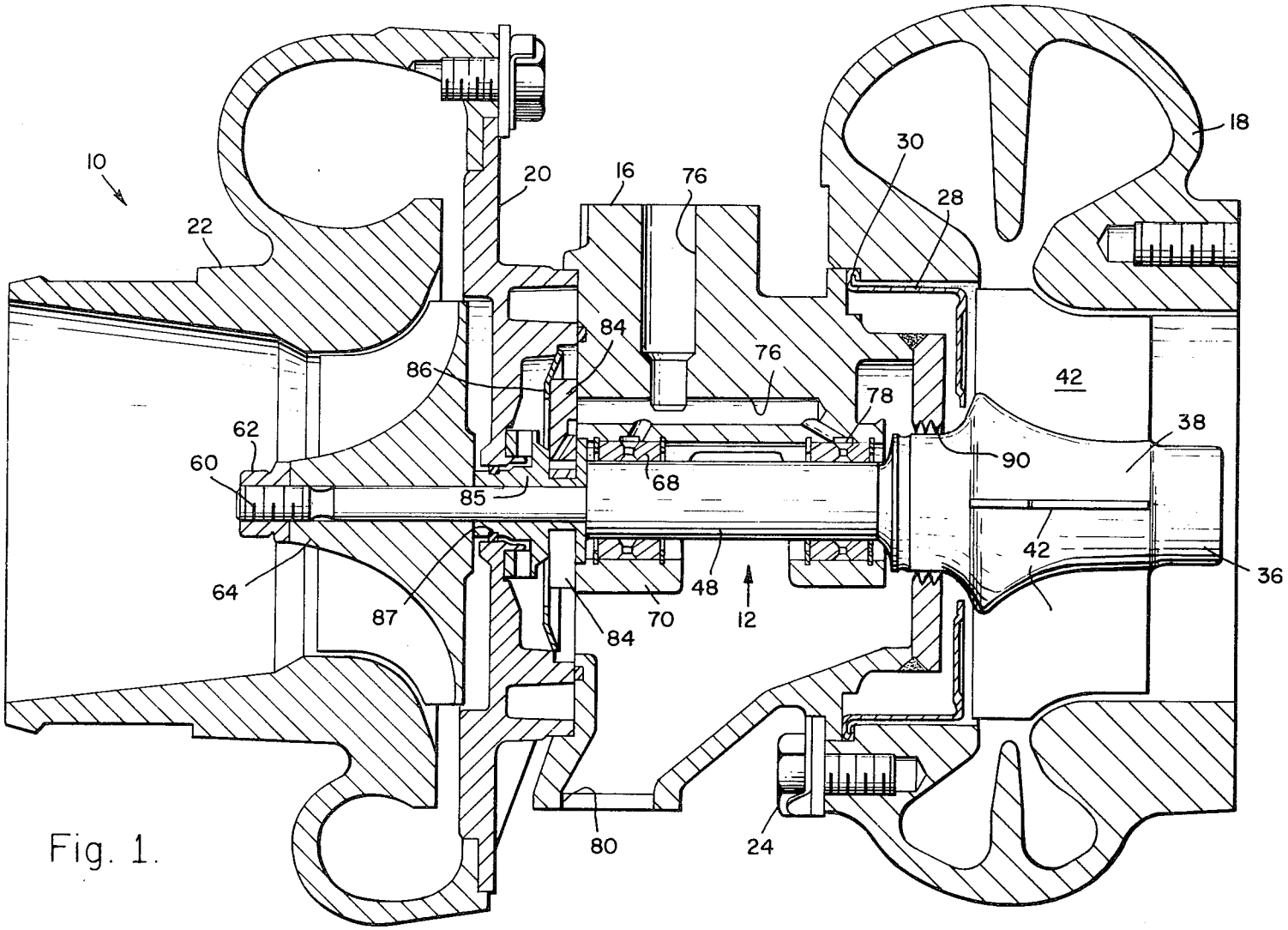
FIG. 1 is a partially cross-sectioned view of a turbocharger according to the present invention utilizing a rotor shaft assembly also according to the present invention.
Figure 3:
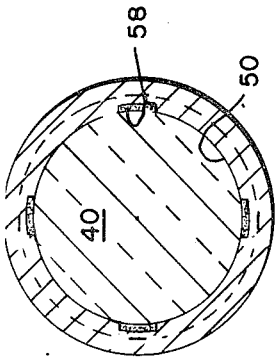
FIG. 3 is a cross-sectional view of the metal to ceramic joint of the present invention taken along line 3—3 of FIG. 2.
Figure 2:
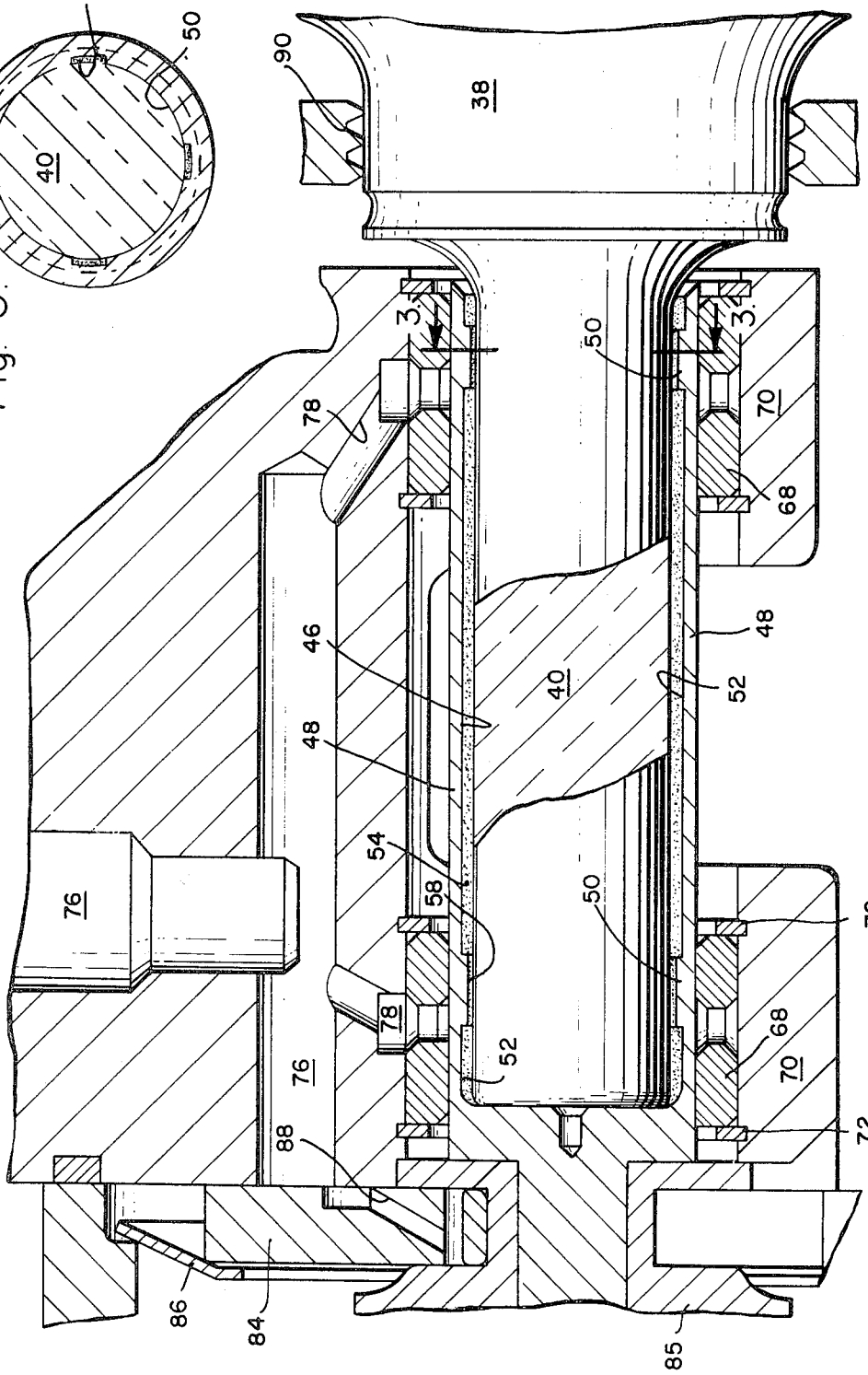
FIG. 2 is an enlarged cross-sectional view of the metal to ceramic joint area of the turbocharger according to the present invention.

Referring now to the drawings, a turbocharger generally designated by the reference numeral 10 is shown to include a rotor-shaft assembly generally designated by the reference numeral 12 also according to the present invention. The turbocharger includes a center housing 16, turbine housing 18, compressor backplate 20, and compressor housing 22 all securely interconnected as by bolts 24 or other suitable means into an integrated assembly.

A heat shield 28 is shown as retained by the interaction of portions of turbine housing 18 and center housing 16 with flange 30 near one end of the center housing to at least partially prevent the excessive heat in the exhaust gases which travel through the turbine housing 18 from moving into the center housing 16.

The rotor shaft assembly 12 is shown to include ceramic turbine rotor 36 having a solid hub 38 which includes a solid ceramic male stub shaft 40. A plurality of blades 42 are spaced periodically about the hub 38 to capture the energy which is present in the engine exhaust gases which are introduced into the turbine housing and turn that energy into rotational mechanical energy of the turbine. The turbine may be formed of any of a variety of silicon ceramic derivatives. It should be noted that the solid hub 38 and stub shaft 40 are symmetrically distributed about the axis of the turbine rotor 36.

The stub shaft 40 is inserted into a generally cylindrical female cavity 46 in the shaft 48. The female cavity is generally symmetrically distributed about the axis of the shaft and is provided with a plurality of spaced lands 50 which project from the inner surface of the metal shaft 48 and which engage or cooperate with the stub shaft to assure coaxial mating of the turbine rotor 36 and the shaft 48 to assure torque transmission capability. The lands 50 are bordered by recessed areas 52 which receive a silicate bonded alumina adhesive 54 which forms a bond between the metal shaft and the ceramic stub shaft 40. The silicate bonded alumina adhesive 54 may be of any suitable type which is nondegradable at temperatures below 800° F. and can be for instance an Aerolix ATC-201 type adhesive which may be presently purchased in the marketplace. The lands 50 are provided with a series of reliefs 58 which allow the adhesive 54 to move when in its unsolidified state, as during assembly, and uniformly distribute itself about the stub shaft 40 so as to permit adequate uniform bonding and removal of excess from the female cavity.

The end of the shaft 48 which extends into compressor housing 22 includes a threaded portion 60 which receives a cooperating nut 62 to securely retain a compressor wheel 64 coaxially thereon for simultaneous rotation therewith in response to rotation of the turbine rotor 36. The rotor-shaft assembly 12 is suitably journaled for rotation as by bearings 68 which are retained in bearing bosses 70 by snap rings 72.

The bearings are lubricated and cooled in the metal to ceramic joint area and the adhesive 54 is maintained below the maximum temperature limits by oil flow from the engine which is supplied to center housing 16 through main artery 76 and a variety of capillaries 78. The cooling lubricating oil leaves the center housing 16 through drain hole 80.

A thrust bearing 84 is received over thrust collar 85 and retained in position against the center housing. The interaction of spring 86 and compressor backplate 20 prevent axial movement of the rotor-shaft assembly 12. A seal ring 87 is provided in the thrust collar 85 to prevent oil which is supplied to the thrust bearing 84 and thrust collar 85 through capillary 88 from leaking into the compressor housing 22. In a similar fashion, a turbine end labyrinth seal 90 is provided to prevent oil leakage from the center housing 16 into the turbine housing 18.

After the individual component parts are fabricated, the turbocharger 10 according to the present invention which utilizes a rotor-shaft assembly 12 according to the present invention is assembled as follows. First, the female cavity 46 of the shaft 48 is filled with a suitable silicate bonded alumina adhesive and the stub shaft 40 of the ceramic turbine rotor is inserted therein for coaxial mating therewith. The adhesive is then allowed to cure sufficiently so that a secure bond is formed between the metal shaft 48 and the stub shaft 40 which will not degrade below temperatures in the neighborhood of 800° F.

The bearing 68 and snap rings 72 are mounted in bearing bosses 70 and the heat shield 28 is then located near the end of the center housing as shown in FIG. 1. The integrated or intersecured turbine rotor 36 and metal shaft 48 is then slid into the center housing 16. The turbine housing 18 is then placed over the turbine rotor 36 so that it impinges upon flange 30 of heat shield 28 and is secured to the center housing 16 as by bolts 24 so as to integrate the same thereto. The thrust collar 85 is then placed over the compressor end of the shaft and slid so that one of its ends is in abuttment with the portion of the shaft 48 which contains the female receptacle 46. Thrust bearing 84 is then placed over the thrust collar 85 and spring 86 is laid atop thereof. The compressor backplate 20 is then slid overtop of the shaft 48 so as to impinge on spring 60 and is secured to the center housing 16 as by bolts (not shown in the drawings). The compressor wheel 64 is then slid over the threaded end of the shaft 48 and secured thereto as by nut 62. The compressor housing 22 is then slid over top of the compressor wheel 64 and secured to the backplate as by bolts 24 to form an entirely integrated turbocharger construction 10 according to the present invention.

In operation then the turbocharger 10 of the present invention is intended for use with an internal combustion engine preferably of the reciprocating type, which emits hot exhaust gases which are fed through exhaust manifolds (not shown in the drawings) to the turbine housing 18 for swirling motion thereabout so as to drive turbine rotor 36 about its axis thereby driving shaft 48 coaxially therewith thereby translating the energy available in the exhaust gases into shaft torque. The compressor is thus driven by the rotational motion of the turbine 36 and shaft 48 to compress air and supply it to the engine in the form of boost energy. The heat shield 28 protects the center housing and the adhesive metal to ceramic joint from the excessive temperatures which are found in the exhaust gases which typically will exceed 1000° F. Oil from the engine is supplied to the turbocharger center housing 16 and thrust collar 85 through main artery 76 and capillaries 78 and 88 to lubricate and cool the shaft as it rotates. The combined effects of the oil cooling and heat shield protection maintains the center housing temperature in the area of the adhesive joint well below the 800° F. maximum temperature thereby providing generally faultless operation.

Importantly, it should be understood that this invention may include a variety of modifications without departing from the scope or spirit of the invention. In particular, it is contemplated that the invention may be used in a wide variety of applications and the true spirit of the present invention should not be limited by way of the above-detailed description, but rather should be construed in light of the appended claims wherein what is claimed and desired to be secured by U.S. Letters patents is:

We claim:

1. A rotor shaft assembly of the type used in a turbocharger for rotating about its axis to drive a compressor and supply compressed air to an internal combustion engine comprising:

a metal shaft having a compressor impeller mounted at one end thereof and defining a coaxial bore extending into the shaft at the other end thereof, said shaft including at least one generally annular land projecting radially inward from said shaft into the coaxial bore and having an axial length less than that of the bore with recessed areas in flanking relationship to said at least one land, said at least one land including at least one axially oriented relief groove therethrough.

a ceramic turbine rotor including a generally cylindrical stub shaft coaxially located by and in contact with said at least one land, thereby defining an annular space between said stub shaft and said metal shaft, and a high temperature adhesive in said annular space for securing said stub shaft to said metal shaft in a torque transmitting relationship.

2. The rotor-shaft assembly according to claim 1 wherein each of the at least one land defines a coaxial inner diameter surface area.

3. The rotor-shaft assembly according to claim 2 wherein the stub shaft has a diameter sized to fit snugly within said inner diameter surface area of said land.

4. The rotor-shaft assembly of claim 1 wherein said adhesive is a silicate bonded alumina compound.

5. The rotor-shaft assembly of claim 1 wherein said adhesive is nondegradable at temperatures below 800° F.

6. The rotor-shaft assembly of claim 1 wherein one land is formed near each end of said bore.

7. A turbocharger of the kind including an exhaust gas driven turbine rotatably coupled to a compressor impeller to thereby compress air and supply the same to the engine in the form of boost energy comprising:

a metal shaft having an axially extending generally cylindrical cavity therein at one end thereof, at least one annular land projecting radially inward into the cavity, said at least one land defining an inner diameter surface area and having at least one axially extending relief groove in said inner diameter surface for allowing fluid communication between areas adjacent each side of said land, a ceramic turbine rotor including a generally cylindrical stub shaft having a diameter approximately equal to that of the inner diameter surface area of said at least one land and matable therein for coaxial alignment and rotation therewith in response to exposure of the turbine rotor to the hot engine exhaust gas flow, and a high temperature adhesive for intersecuring said metal shaft and said stub shaft in torque transmitting relationship, thereby creating a ceramic-metal adhesive joint.

8. The turbocharger according to claim 7 further including a bearing means having a lubrication system operably associated with said metal shaft, said bearing means positioned about the ceramic-metal adhesive joint.

9. The turbocharger according to claim 8 wherein the lubrication system thermally isolates the ceramic-metal adhesive joint from degrading effects of said hot engine exhaust gases.

10. The turbocharger according to claim 7 wherein the cavity has an axial length greater than that of said lands.

11. The turbocharger according to claim 7 wherein one land is formed near each end of said cavity.

* * * * *